United States Patent [19]

Kasai et al.

[11] Patent Number: 4,527,532

[45] Date of Patent: Jul. 9, 1985

[54] FUEL-VAPOR EMISSION CONTROL SYSTEM FOR AN AUTOMOTIVE ENGINE

[75] Inventors: Yoshiaki Kasai, Kiyose; Yasuo Hiraoka, Hachioji; Masaharu Yuasa, Fujisawa; Masataka Harada; Masao Saito, both of Oota, all of Japan

[73] Assignee: Fuji Jukogyo Kabushiki Kaisha, Tokyo, Japan

[21] Appl. No.: 611,273

[22] Filed: May 17, 1984

[30] Foreign Application Priority Data

May 19, 1983 [JP] Japan ..... 58-88071

[51] Int. Cl.[3] ..... F02M 33/02

[52] U.S. Cl. ..... 123/520; 123/518

[58] Field of Search ..... 123/518, 519, 520

[56] References Cited

U.S. PATENT DOCUMENTS 4,127,097 11/1978 Iakimoto ..... 123/520

4,326,489 4/1982 Heitert ..... 123/520

4,446,838 5/1984 Suzuki ..... 123/520

*Primary Examiner*—Ronald H. Lazarus

*Attorney, Agent, or Firm*—Martin A. Farber

[57] ABSTRACT

A fuel-vapor emission control system has a canister having a vacuum operated purge control valve, communicated with a float chamber of a carburetor and a fuel tank for purging fuel-vapor. A vacuum chamber of the vacuum operated purge control valve is communicated with a port provided in the carburetor so as to apply manifold vacuum to the vacuum chamber at partial-throttle operation. Parallel purge lines are provided for communicating the canister with an intake manifold of the engine. A solenoid operated valve is provided in one of the purge lines for controlling the purging of the fuel-vapor. The solenoid operated valve is opened for the purging by a signal from a vehicle or engine speed sensor under such conditions that the engine does not stall.

11 Claims, 1 Drawing Figure

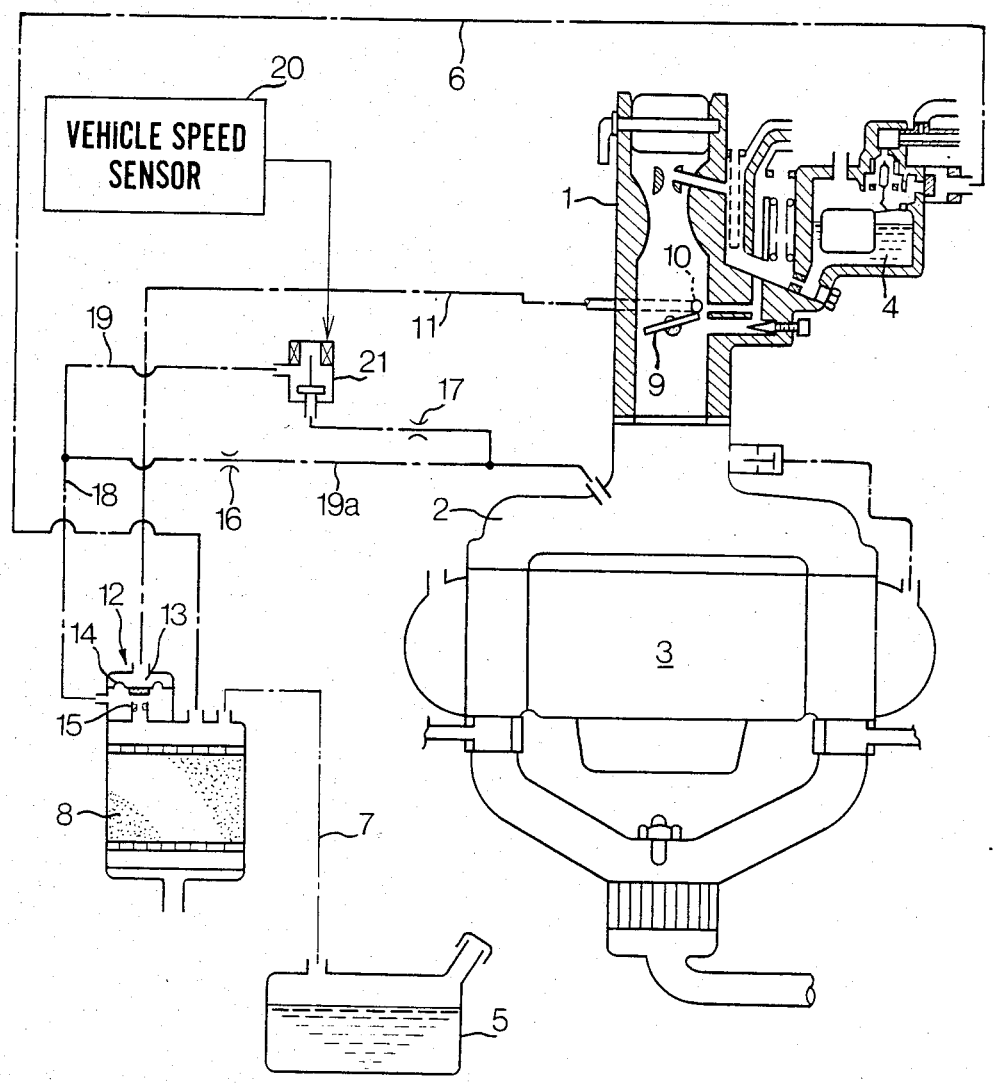
VEHICLE SPEED SENSOR
20
6
1
10
4
11
19
21
9
17
18
16
19a
2
12
13
14
3
15
8
7
5

FUEL-VAPOR EMISSION CONTROL SYSTEM FOR AN AUTOMOTIVE ENGINE

BACKGROUND OF THE INVENTION

The present invention relates to a fuel-vapor emission control system using a charcoal canister for an automotive engine.

There is provided a fuel-vapor emission control system in the automotive engine for preventing air pollution. When the engine operation is stopped, evaporated fuel in a fuel tank and a carburetor is captured and adsorbed by activated charcoal in a charcoal canister of the control system. While the engine is running, the fuel-vapor stored in the canister is purged by intake-manifold vacuum to flow back to the intake system for combustion. A purge control of the canister is provided having a purge control valve provided on the canister which is adapted to be opened by vacuum at a port formed in an intake passage at part throttle operation. The port is positioned just above a throttle valve when it is closed, and hence the fuel-vapor in the canister is delivered together with air into the intake system. Therefore, at starting of a vehicle, when an accelerator pedal is slightly depressed, a large amount of purging takes place. A large amount of vapor by the purging enriches the air-fuel mixture, which will cause the engine to stall.

In order to remove such disadvantages, there is provided a fuel-vapor emission control system for limiting the amount of purging when starting a vehicle. For example, Japanese utility model publication No. 56-54375 discloses a system in which a solenoid operated valve is provided in a purge line and the solenoid is connected in series to a vehicle speed sensor and to a vacuum switch which detects an opening degree of a throttle valve. However, in such a system, purging does not occur at the starting, and it is adapted to take place only at a predetermined vehicle speed. As a result, a decrease of the amount of purging causes an overflow of fuel-vapor from the canister.

SUMMARY OF THE INVENTION

An object of the present invention is to provide a fuel-vapor emission control system which effectively controls the amount of purging according to engine operating conditions so as to prevent the overflow of fuel-vapor and stalling of an engine at starting of a vehicle.

According to the present invention, there is provided a fuel-vapor emission control system for an automotive engine mounted on a vehicle, the system comprising a canister having a vacuum operated surge control valve, communicating with a float chamber of a carburetor and with a fuel tank for purging fuel-vapor, a passage for communicating a port provided in the carburetor with a vacuum chamber of the vaccum operated purge control valve so as to apply manifold vacuum to the vacuum chamber at partial-throttle operation. Parallel purge lines are provided for communicating the canister with an intake manifold of the engine. A solenoid operated valve is provided in one of the purge lines for controlling the purging of the fuel-vapor. The solenoid operated valve is opened by a signal of a vehicle or engine speed sensor so as not to stall the engine.

The other objects and features of this invention will be apparently understood from the following description with reference to the accompanying drawings.

BRIEF DESCRIPTION OF DRAWINGS

A single FIGURE shows a schematic view of a fuel-vapor emission control system according to the present invention.

DETAILED DESCRIPTION OF THE PREFERRED EMBODIMENT

Referring to the drawing, an internal combustion engine 3 is provided with a carburetor 1 communicated with an intake manifold 2 of the engine. A float chamber 4 of the carburetor 1 and a fuel tank 5 are communicated with a canister 8 by fuel-vapor induction lines 6 and 7 respectively for adsorbing and storing fuel-vapor. The canister 8 is filled with particles of activated charcoal and has a purge control valve 12 provided on the upper portion thereof. The purge control valve 12 comprises a vacuum chamber 13 defined by a diaphragm 14 and a valve port 15 normally closed by the diaphragm 14. A port 10 formed in the carburetor 1 is communicated with the vacuum chamber 13 by a vacuum passage 11. The port 10 is located just above the upward swinging end of a throttle valve 9 in its closed position so that it is exposed to induction vacuum when the throttle valve 9 is partly opened. A purge line 18 having parallel purge lines 19 and **19*a*, which have orifice-type restrictors 16 and 17 respectively, is provided to communicate the valve port 15 with the intake manifold 2. A solenoid operated valve 21 is provided in the purge line 19 and operated by a signal from a vehicle speed sensor 20. The vehicle speed sensor 20 is adapted to generate the signal to open the solenoid valve 21** when the vehicle speed exceeds a predetermined value.

When the engine operation is stopped at a high temperature, especially in summer, a large amount of fuel evaporates in the float chamber 4 and fuel tank 5. The fuel-vapor flows into the canister 8 passing through the fuel-vapor induction lines 6 and 7, so that fuel-vapor is adsorbed and stored by the charcoal. In idling or deceleration state after the engine is started, the throttle valve 9 is closed so that the atmospheric pressure is applied to the vacuum chamber 13 of the purge control valve 12 through the port 10 and the vacuum passage 11. Accordingly, the diaphragm 14 is deflected to close the valve port 15 and the purging does not take place. When the throttle valve 9 is opened over the port 10, the manifold vacuum is applied to the vacuum chamber 13 through the port 10 and the passage 11. Hence the diaphragm 14 of the purge control valve 12 is deflected upwardly to open the valve port 15 so that the valve port 15 communicates with purge lines 18, 19 and **19*a*. By the manifold vacuum, atmosphere is sucked into the canister 8 through bottom holes and through the charcoal to purge the fuel-vapor from the charcoal in the canister 8** which passes to the intake manifold.

When starting, since the vehicle speed is lower than the predetermined value, the solenoid valve 21 provided in the purge line 19 is not excited so that the purge line 19 is closed by the valve 21. Therefore, the fuel-vapor purged from the canister passes through only the purge line **19*a* in which the orifice 16 operates to restrict the flow of fuel-vapor for preventing stalling of the engine. When the vehicle speed exceeds the predetermined value, the solenoid valve 21 is opened by the signal from the speed sensor 20. Consequently, fuel-vapor flows through both purge lines 18, 19 and 19***a*. Thus, a sufficient amount of purging takes place.

The vehicle speed sensor of the present invention can be replaced with an engine speed sensor. The system of the present invention is applicable to a system in which a thermo valve is provided on the vacuum passage 11 for high idling speed in cold engine state.

In accordance with the present invention, since the purge control valve is connected to two purge lines having orifice-type restrictors for the fuel-vapor flow control and the solenoid operated valve is provided on one of the purge lines so as to be operated by the vehicle speed sensor, the amount of purging is controlled according to the vehicle speed. Therefore, the stalling of the engine and fuel-vapor overflow can be prevented.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A fuel-vapor emission control system for an automotive engine mounted on a vehicle, the engine having an intake manifold communicating with a carburetor having a float chamber, and a fuel tank, comprising:

a canister having a vacuum-operated purge control valve, and said canister being communicated with said float chamber and said fuel tank for purging fuel-vapor;

a passage communicating a port in said carburetor with a vacuum chamber of said vacuum-operated purge control valve so as to apply manifold vacuum to said vacuum chamber at partial-throttle operation;

purge passage means for communicating said canister with said intake manifold;

said purge passage means comprises parallel purge lines meeting upstream and downstream with a common line being fed to said intake manifold, valve means provided in only one of said purge lines for controlling the purging of the fuel-vapor; and means for opening said valve means under such conditions that the engine does not stall.

2. The fuel-vapor emission control system according to claim 1 wherein:

said valve means is a solenoid-operated valve.

3. The fuel-vapor emission control system according to claim 2 wherein:

said means for opening said valve means is a vehicle speed sensor for producing a signal when vehicle speed exceeds a predetermined value.

4. The fuel-vapor emission control system according to claim 1, wherein:

each of said purge lines has an orifice-type restrictor.

5. The fuel-vapor emission control system according to claim 1, further comprising:

a thermo valve provided in said passage adapted for high idling speed of the engine in a cold condition.

6. The fuel-vapor emission control system according to claim 1, wherein:

said purge passage means communicates with said canister via said purge control valve.

7. In a fuel-vapor emission control system for an automotive engine mounted on a vehicle, having an intake manifold, a carburetor, a float chamber, a fuel tank, a canister communicated with said float chamber and said fuel tank for purging fuel-vapor, a vacuum-operated purge control valve having a vacuum chamber, a passage communicating a port in said carburetor with the vacuum chamber so as to apply manifold vacuum to said vacuum chamber at partial-throttle operation, purge passage means for communicating said canister with said intake manifold, the improvement wherein:

said purge passage means comprising parallel purge lines which meet upstream and downstream with a common line being fed to the intake manifold, a solenoid-operated valve means provided in one of the purge lines, a vehicle speed sensor for producing a signal for opening the solenoid-operated valve means when the vehicle speed exceeds a predetermined value, so as to increase the amount of the purged fuel-vapor.

8. The fuel-vapor emission control system according to claim 7, wherein:

each of said purge lines has an orifice-type restrictor.

9. The fuel-vapor emission control system according to claim 7, further comprising:

a thermo valve provided in said passage adapted for high idling speed of the engine in a cold condition.

10. The fuel-vapor emission control system according to claim 7, wherein:

said purge passage means communicates with said canister via said purge control valve.

11. In a fuel-vapor emission control system for an automotive engine mounted on a vehicle, having an intake manifold, a carburetor, a float chamber, a fuel tank, a canister communicated with said float chamber and said fuel tank for purging fuel-vapor, a vacuum-operated purge control valve having a vacuum chamber, a passage communicating a port in said carburetor with the vacuum chamber so as to apply manifold vacuum to said vacuum chamber at partial-throttle operation, purge passage means for communicating said canister with said intake manifold, the improvement wherein:

said purge passage means comprising parallel purge lines which meet upstream and downstream with a common line being fed to the intake manifold, a valve means provided in one of the purge lines, a speed sensor for producing a signal for opening the valve means when the speed exceeds a predetermined value, so as to increase the amount of the purged fuel-vapor.

* * * * *